US007307501B2

(12) United States Patent
Doi

(10) Patent No.: US 7,307,501 B2
(45) Date of Patent: Dec. 11, 2007

(54) PERMANENT MAGNET PACKAGE, METHOD FOR MANUFACTURING SAME, AND METHOD FOR TRANSPORTING PERMANENT MAGNET

(75) Inventor: Yuhito Doi, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 11/076,118

(22) Filed: Mar. 9, 2005

(65) Prior Publication Data

US 2005/0200441 A1 Sep. 15, 2005

(30) Foreign Application Priority Data

Mar. 15, 2004 (JP) ..... 2004-072401

(51) Int. Cl.
*H01F 7/02* (2006.01)

(52) U.S. Cl. ..... 335/306; 335/302

(58) Field of Classification Search ..... 335/302–306
See application file for complete search history.

(56) References Cited

U.S. PATENT DOCUMENTS 3,727,658 A * 4/1973 Eldridge, Jr. ..... 335/303
5,036,866 A * 8/1991 Eldrige et al. ..... 128/849

* cited by examiner

*Primary Examiner*—Elvin Enad
*Assistant Examiner*—Bernard Rojas
(74) *Attorney, Agent, or Firm*—Myers, Bigel, Sibley & Sajovec, P.A.

(57) ABSTRACT

It is an object of the present invention to provide a package for permanent magnets in which the amount of magnetic field that leaks externally is reduced, and that is stable. There is provided a permanent magnet package 1 comprising: a plurality of magnet rows, wherein each of the magnet rows comprises a plurality of permanent magnets 2, wherein the magnetization direction of all the permanent magnets in a single magnet row is the same, and is parallel to the magnet row, and wherein the plurality of the magnet rows are arranged such that the magnetization direction of adjacent rows is opposite; and the method for manufacturing the same.

13 Claims, 2 Drawing Sheets

PERMANENT MAGNET PACKAGE, METHOD FOR MANUFACTURING SAME, AND METHOD FOR TRANSPORTING PERMANENT MAGNET

RELATED APPLICATION

This application claims priority from Japanese Patent Application No. 2004-072401, filed Mar. 15, 2004, the disclosure of which is incorporated by reference herein in its entirety.

BACKGROUND OF THE INVENTION

1. Field of the Invention

The present invention relates to permanent magnet packages, to methods for manufacturing the same, and to methods for transporting permanent magnets.

2. Description of Related Art

In recent years, strong permanent magnets such as NdFeB-based rare earth permanent magnets have been developed. These permanent magnets are utilized in applications such as head drive devices for hard disk drives, which are computer parts, and in MRI devices, which are devices for medical diagnosis. The industrial fields in which they are being utilized are widening. Along with this, there is also an increase in the volume of magnetized permanent magnets transported from permanent magnet manufacturers to equipment manufacturers and users.

On the other hand, with the development of an information-based society, a lot of information is written onto magnetic recording media. For example, as with floppy disks, magnetic recording technology is also used in items that people usually carry around with them, such as credit cards. These magnetic recording media have a drawback in that they are susceptible to the effects of external magnetic fields. Furthermore, the effect of external magnetic fields on watches and mobile phones that general public carries with him is not favorable.

Polarized permanent magnets generate a magnetic field continuously, while the strength of the magnetic field will change depending on the type, size and shape of the permanent magnet. Thus, there is the problem that magnetic recording media may be destroyed or that electronic instruments may be damaged by a magnetic field that leaks from packed permanent magnets when transporting the magnetized permanent magnets.

When transporting magnetized magnets by sea, a plurality of magnets is packed in a container such as a single wooden packing case. Up to this time, it has been standard practice to pack the individual magnets so as to maintain sufficient space such that they may be separated even if the magnets stick together because of their magnetic strength, and also, to put the individually packed magnets in an even larger container.

SUMMARY OF THE INVENTION

Conventionally, when packing a plurality of magnetized permanent magnets in a single container there has been no particular principle to guide the manner in which the magnets were packed. Thus, it has been standard practice to pack the individual magnetized permanent magnets so as to maintain sufficient space to separate the magnets even if they become stuck together, and to insert the permanent magnets in a straight row such that their magnetization direction is aligned. However, when the magnets are packed in such a manner, the plurality of magnets faces the same direction. Thus, these magnets act as a single large magnet with respect to the outside, and the size of the magnetic field that leaks out increases. Although it is possible to reduce the magnetic field that leaks out by applying iron plates to the inside of the container, by inserting the magnets such that their magnetization direction is aligned, the plurality of magnets are treated as a single large magnet, thus there is the problem that the amount of iron plates increases as does the weight of the container.

Accordingly, it is an object of the present invention to provide a package for permanent magnets in which the amount of magnetic field that leaks externally is reduced, and that is stable.

In one aspect of the present invention, there is provided a permanent magnet package comprising: a plurality of magnet rows, wherein each of the magnet rows comprises a plurality of permanent magnets, wherein the magnetization direction of all the permanent magnets in a single magnet row is the same, and is parallel to the magnet row, and wherein the plurality of the magnet rows are arranged such that the magnetization direction of adjacent rows is opposite. In another aspect of the invention, there is provided a permanent magnet package comprising a plurality of permanent magnets, wherein when packing by arranging the permanent magnets in a packing container, each of the permanent magnets is arranged in such orientations that a total length of straight lines that link N poles and S poles of the permanent magnets to be closed is minimized among cases when the same number of permanent magnets are arranged.

In another aspect of the invention, there is provided a method for manufacturing a permanent magnet package, the method comprising: providing a magnet row comprising a plurality of permanent magnets, wherein the magnet row is arranged such that the magnetization direction of all the permanent magnets in a single magnet row is the same, and is parallel to the magnet row; and arranging a plurality of the magnet rows of the permanent magnets such that each of the permanent magnet rows has a magnetization direction opposite to the magnet row adjacent thereto. In another aspect of the invention, there is provided a method for manufacturing a permanent magnet package comprising a plurality of permanent magnets, the method comprising: arranging the permanent magnets such that when packing by arranging the permanent magnets in a packing container, each of the permanent magnets is arranged in such orientations that a total length of straight lines that link N poles to the S poles of the permanent magnets to be closed is minimized among cases when the same number of permanent magnets are arranged. In another aspect of the invention, there is provided a method for transporting a plurality of permanent magnets, the method comprising: transporting the plurality of permanent magnets by using the above permanent magnet-package.

For example, the present invention may be applied such that each magnet is packed separately in polystyrene foam, corrugated cardboard or the like so that each magnet can be taken out separately, and subsequently the magnets are put into a large box. It seems that there are a variety of ways of lining up the magnets when packing a plurality of magnets, however when the magnetization direction of all the magnets is lined up in the same direction, the magnets may be packed in a stable condition because the magnets are attracted to each other. However, in this case, the magnets may be considered to be one large magnet from the outside, and there is the problem that the leaking magnetic field is large. On the other hand, if the magnets are packed such that all the magnets are in opposition, then although leakage of the magnetic field is reduced because the magnetic flux of all the magnets is cancelled out, the magnets are not stable. As will be described in detail below, with the present invention it is possible to provide a permanent magnet package in which leakage of the magnetic field to the outside is reduced, and that is stable, and by utilizing the permanent magnet package according to the present invention, a plurality of permanent magnets may be favorably transported and stored, for example.

BRIEF DESCRIPTION OF THE DRAWINGS

FIG. 1(*a*) shows a case in which four permanent magnets are arranged in two rows. FIG. 1(*b*) shows a case in which six permanent magnets are arranged in two rows. FIG. 1(*c*) shows a case in which eight permanent magnets are arranged in two rows. FIG. 1(*d*) shows a case in which eight permanent magnets are arranged in two rows and two levels. The upper side of FIG. 1(*d*) is a schematic plan view, and the lower side of FIG. 1(*d*) is a schematic front view.

DETAILED DESCRIPTION OF PREFERRED EMBODIMENTS

Figure 1A:
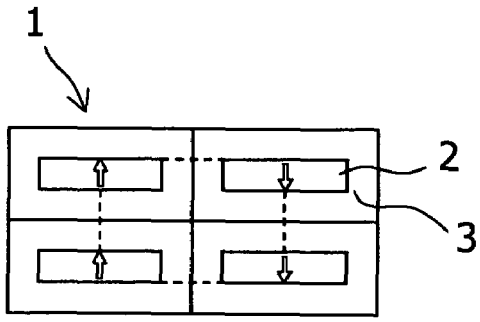
FIG. 1 schematically shows examples of the permanent magnet package according to the present invention.
Figure 1B:
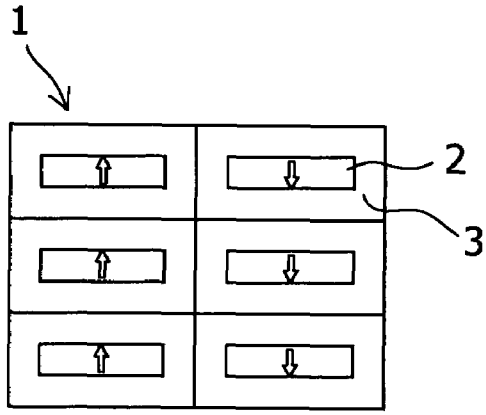
Figure 1C:
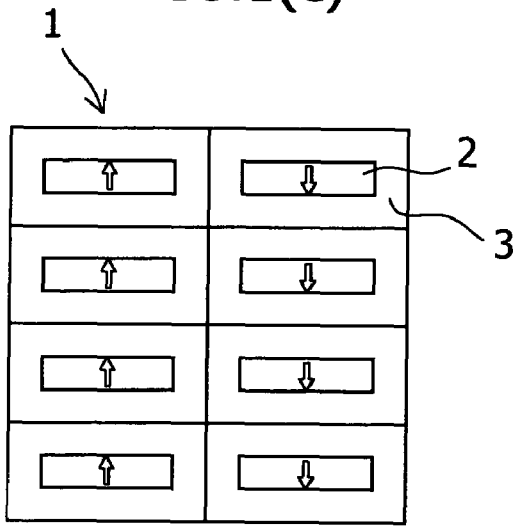
Figure 1D:
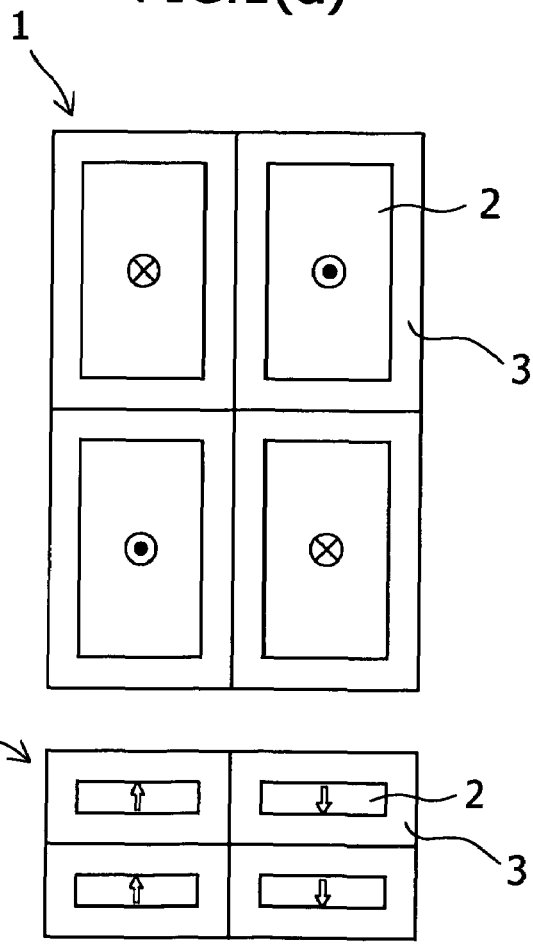

Embodiments of the present invention are described below with reference to the attached drawings. Of course, the embodiments described below do not limit the present invention.

Rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element is referred to as being "on" another element, it can be directly on the other element or intervening elements may also be present.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs.

There is no particular limitation to the magnets to which the present invention may be applied, and the magnets comprise sintered and bonded magnets. Examples of these comprise rare earth (eg. Nd and Sm-based), ferrite, and alnico magnets. Of these, the present invention is particularly effective to rare earth sintered-magnets that have a high magnetic strength, and have an energy product of at least 200 kJ/m$^3$ which may lead to large magnetic field leakage. It should be noted that there is no particular limitation to the shape of the magnets, and it is possible to select any shape from shapes such as cubic, rectangular, rowar, spherical, cylindrical and ring-shaped. It should be noted that it is possible that each of the plurality of permanent magnets may be of a different type, material, energy product and shape, however it is preferable that the permanent magnets are of the same type and the like. This makes it easier to arrange the magnets more stably.

It is preferable that the number of permanent magnets for packing is an even number. As is described in detail below, this is because by arranging an even number of magnet rows that have the same number of magnets, it is possible to set the total length of lines shorter, that link the N and S poles of all the permanent magnets so as to be closed, and it is possible to arrange the magnets more stably.

Various magnet arrangements may be employed depending on the number of magnets. For example, the magnets may be arranged in accordance with the following rules. In one embodiment of the present invention, there is provided a permanent magnet package comprising: a plurality of magnet rows, wherein each of the magnet rows comprises a plurality of permanent magnets, wherein the magnetization direction of all the permanent magnets in a single magnet row is the same, and is parallel to the magnet row, and wherein the plurality of the magnet rows are arranged such that the magnetization direction of adjacent rows is opposite. By arranging the magnets within the same magnet row such that the magnetization direction of all magnets is the same and parallel to the direction of the magnet row, the magnet rows are stabilized due to attraction by the magnetic force between the magnets. It should be noted that the number of permanent magnets comprised in each magnet row is preferably the same. As is described in detail below, this makes it possible to set the total lengths of lines shorter, that link the N poles and S poles of all the permanent magnets so as to be closed, and the permanent magnets can be arranged with greater stability.

In addition, in the permanent magnet package according to the present invention, the plurality of magnet rows is arranged such that the magnetization directions of adjacent magnet rows are opposed. By arranging the magnet rows in this way, the adjacent magnet rows are stabilized due to attraction by the magnetic force between the magnet rows. Additionally, by arranging the magnet rows in this way, the magnetic flux of the permanent magnets that are arranged oppositely is cancelled out, and the permanent magnets may be packed in a manner in which external leakage of the magnetic field is small. Magnetization direction of a magnet row means the magnetization direction of the plurality of magnets (these have the same magnetization direction) that are included in the magnet row. Furthermore, in the present application, if the magnet row that is positioned closest to a magnet row A is a magnet row B, then the magnet row A and the magnet row B are taken to be adjacent to each other. That is to say, that two magnet rows are adjacent to each other means that a magnet row that is positioned closest to at least one of the two magnet rows is the other of the two magnet row. Furthermore, it is preferable that at least one of the N pole end or the S pole end and preferably both ends of the magnet row are arranged such that the poles are aligned with those of the adjacent magnet row. This is because it is possible to set the total length of lines shorter, that link the N poles and S poles of all the permanent magnets so as to be closed, and because the permanent magnets can be arranged with greater stability. The magnet rows may be arranged horizontally, and a plurality of magnet rows may be lined up and arranged spatially, that is to say three-dimensionally. Moreover, it is also possible to load and transport, for example, permanent magnet packages that are made by arranging magnet rows in two dimensions or three dimensions.

It should be noted that it is preferable that the number of magnet rows is an even number. As is described in detail below, this is because when the number of magnet rows is set to an even number, it is possible to set the total lengths of lines shorter, that link the N poles and S poles of all the permanent magnets so as to be closed, and the permanent magnets can be arranged with greater stability. On the other hand, when the number of magnet rows is an odd number, it cannot be avoided that one of the lines that link the N poles and S poles of the magnets must be extended by the length of the row. Furthermore, when the number of magnet rows is an even number, the number of permanent magnets included in the magnet rows can be the same, and it is possible to effectively cancel out the flux of the oppositely arranged permanent magnets and to effectively reduce the magnetic field that leaks out. On the other hand, when the number of magnet rows is odd, in order to effectively eliminate the magnetic flux of the permanent magnets arranged oppositely, the arrangement becomes more complex.

Furthermore, as noted above, in another embodiment of the present invention, there is provided a permanent magnet package comprising a plurality of permanent magnets, wherein when packing by arranging the permanent magnets in a packing container, each of the permanent magnets is arranged in such orientations that a total length of straight lines that link N poles and S poles of the permanent magnets to be closed, in other words, straight lines that link an N pole of each of the permanent magnets and one of S poles of the other permanent magnets with respect to all the permanent magnets so that the lines is to be closed, is minimized among cases when the same number of permanent magnets are arranged. That is to say, as a result of investigations, the present inventors have found that by arranging the permanent magnets such that the total length of lines that link N poles and S poles is minimized, the leaking magnetic field is reduced and it is possible to stably arrange the permanent magnets. That is to say, when packing the plurality of permanent magnets, by setting the direction of the flux of the permanent magnets such that the total length of lines that link the N poles and the S poles of all the permanent magnets so as to be closed is shortened as described above, the leakage of the magnetic field from the permanent magnets is smaller and it is also possible to arrange the permanent magnets with greater stability than if the magnets were arranged such that the magnetization directions differed therefrom, when arranging the same number of permanent magnets in the same positions. If the permanent magnets are arranged such that the length is minimized, the magnetization direction of the permanent magnets is set such that the magnetic field formed by the permanent magnets is canceled out, and thus the leaking magnetic field is reduced. Furthermore, by shortening the length between the N poles and the S poles, the attractive force due to the magnetic force between the magnets and between the magnet rows can be increased and thus the magnets can be further stabilized.

A line that links the N pole of one magnet and the S pole of another magnet is selected so that when linking the N poles and the S poles of all the permanent magnets comprised in the permanent magnet package so as to be closed, the total length of the lines that link the N pole and the S pole is minimized. At this time, each of the magnets is linked to other magnets at the N pole and the S pole by two lines. Linking so as to be closed means that all the permanent magnets are circularly linked by the lines.

In the permanent magnet package of the above-described embodiment, comprising: a plurality of magnet rows, wherein each of the magnet rows comprises a plurality of permanent magnets, wherein the magnetization direction of all the permanent magnets in a single magnet row is the same, and is parallel to the magnet row, and wherein the plurality of the magnet rows are arranged such that the magnetization direction of adjacent rows is opposite, the total length of lines that link the N poles and S poles of the magnets can be set to be approximately only the dimensions of the packing material between the magnets. That is to say, with the permanent magnet package according to the embodiment, the total length of the lines that link the N poles and the S poles is the length of lines linking the N poles and S poles of adjacent permanent magnets within the same magnet row, plus the length of a line linking the N pole of the magnet at the N pole end of the magnet row with the S pole of the magnet at the S pole end of an adjacent magnet row, plus the length of a line linking the S pole of the magnet at the S pole end of the magnet row with the N pole of the magnet at the N pole end of the adjacent magnet row. Here, the length of a line that links the N pole and the S pole between adjacent permanent magnets within the same magnet row can be the same as the thickness of packing material provided between the magnets. Furthermore, while by making the number of permanent magnets in each magnet row the same, it is possible to set the length between the N pole end and the S pole end of each of the magnet rows to be the same, in this case by arranging the magnet rows such that their ends are aligned, the length of the line between the magnets that links the N pole and the S pole can be taken to be the thickness of the packing material provided between the magnets. On the other hand, if the magnetized permanent magnets were packed in a conventional manner such that the magnetization direction of these permanent magnets is aligned to be the same, the line that links the N pole and the S pole of the magnets has a minimum length, but the line that links the endmost N pole and the endmost S pole is the sum of the dimensions of the magnets in the magnetization direction plus the dimensions of the packing material of the individual magnets. It should be noted that the packing material is described below.

FIG. 1 schematically shows examples of the permanent magnet package according to the present invention. FIG. 1(*a*) shows a case in which four permanent magnets are arranged in two rows. FIG. 1(*b*) shows a case in which six permanent magnets are arranged in two rows. FIG. 1(*c*) shows a case in which eight permanent magnets are arranged in two rows. FIG. 1(*d*) shows a case in which eight permanent magnets are arranged in two rows and two levels. The upper side of FIG. 1(*d*) is a schematic plan view, and the lower side of FIG. 1(*d*) is a schematic front view. In the diagram, the magnetization direction of the permanent magnets is shown by arrows. That is to say, as shown in FIG. 1(*a*), in the case in which four permanent magnets are packed, permanent magnets 2, each covered by a packing material 3, may be arranged in two rows, packed, and made into a permanent magnet package according to the present invention. At this time, the magnetization direction of the magnets in the same row is set to be the same, and the magnetization direction of different rows is set to be reversed. In a similar manner, when six or eight permanent magnets are packed, the magnets, each covered with packing material, may be arranged in two rows, and then packed as shown in FIG. 1(*b*) or 1(*c*). Specifically, in the case of six permanent magnets, three magnets are made into a single row, and in the case of eight permanent magnets, four magnets are made into a single row such that the number of rows is an even number. At this time, the magnetization direction of the magnets in the same row is set to be the same, and the magnetization direction of the other row is reversed. FIG. 1(*d*) also shows the case in which eight magnets are arranged three-dimensionally. In all cases, the permanent magnets are arranged such that the total length of a line that links the N poles and S poles of the magnets so as to be closed is minimized. It should be noted that in the case of eight magnets, the length of the lines that link the N poles and the S poles is the same even if they are arranged two-dimensionally, or arranged three-dimensionally. For example if rectangular magnets that are 70×40×10 mm and covered by packing material of 10 mm thick is packed, the length is 160 mm in both cases. Thus, there are cases in which the leaking magnetic field may be similarly reduced by a plurality of arrangement methods, and in such a case, the arrangement method can be selected as appropriate to match the shape of the container in which all the magnets are packed, or the shape of the magnets or the like.

It should be noted that it is preferable that the distance between the individual permanent magnets is set such that the attractive force due to the magnetic force between the permanent magnets is not more than 10 kg, although this does not limit the present invention. This is because the attractive force between the magnets may be easily manually handled provided that the attractive force is not more than 10 kg. It should be noted that as described in detail below, by providing packing material between the permanent magnets, it is possible to adjust the distance between the permanent magnets.

Furthermore, it is preferable that the permanent magnet package according to the present invention further comprises a container for packing all the permanent magnets. Furthermore, it is preferable that the permanent magnet package according to the present invention further comprises at least one packing material provided in at least one, and preferably all spaces between the N pole of one of the permanent magnets and the S pole of the adjacent permanent magnets. Furthermore, it is preferable that at least one, and preferably each of all the permanent magnets are covered with packing material. Here, that the permanent magnets are covered with packing material means not only that the entire permanent magnet is covered with packing material, but also that a part of the permanent magnet, preferably a face of the magnet that faces another permanent magnet is covered by packing material. Furthermore, a plurality of permanent magnets may be covered in packing material together, or be covered individually.

There is no particular limitation to the packing case and the packing material, and it is possible to use common non-magnetic material such as polystyrene foam, urethane foam and corrugated cardboard. In particular, it is preferable to use cushioning material such as polystyrene foam and urethane foam as the packing material between the permanent magnets.

More specifically, individual permanent magnets may be wrapped in wrapping material of common non-magnetic material such as polystyrene foam and corrugated cardboard, and the wrapped individual permanent magnets can be packed in a transport case, for example. Furthermore, the individual permanent magnets may be packed in cushioning material such as polystyrene foam or urethane foam such that the above-noted length is minimized. That is to say, the magnets may be packed by providing a cushion material having openings for inserting the permanent magnets so that the above-noted length is minimized, and inserting the permanent magnets in the openings. Furthermore, cushioning material such as polystyrene foam and urethane foam may also be provided in the gaps between the arranged magnets and the packing material, and between the magnets.

EXAMPLES

Working examples of the present invention are described below with reference to the attached drawings. Of course, the examples described below do not limit the present invention.

Figure 2A:
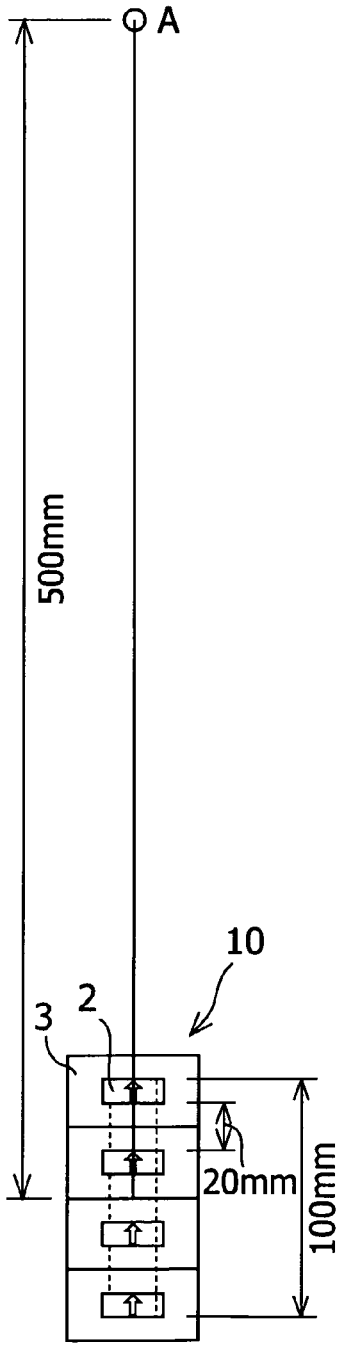
FIG.2(a) (RELATED ART)
FIG. 2 schematically shows views of permanent magnet packages according to the working example and comparative examples.
Figure 2B:
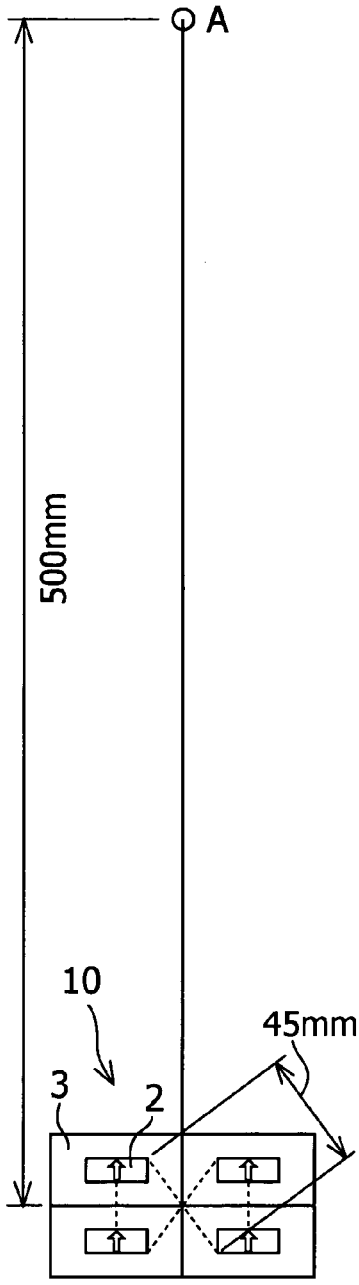
FIG.2(b) (RELATED ART)
Figure 2C:
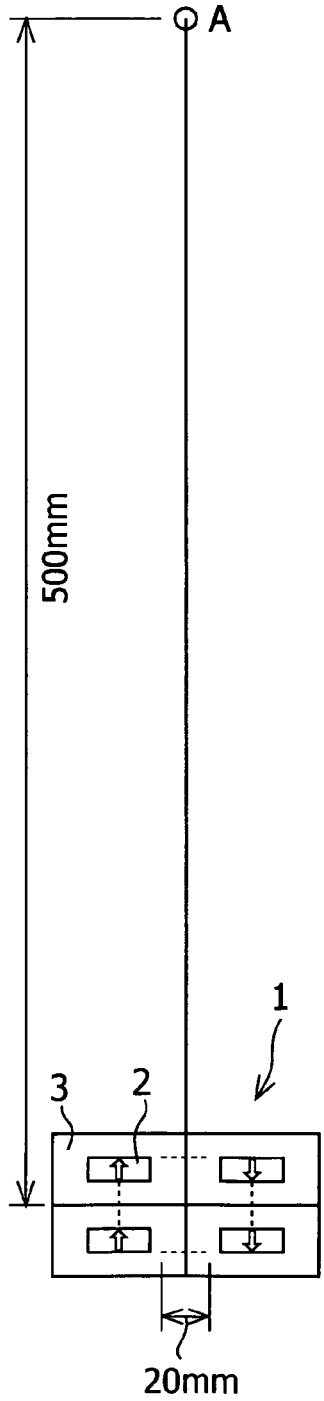
FIG.2(c) (RELATED ART)

FIG. 2 schematically shows views of permanent magnet packages according to the working example and comparative examples. Four magnetized, rectangular magnets of 70×40×10 mm (having an energy product of 320 J/m$^3$) were packed into a cardboard box of 400×300×150 mm. The perimeter of individual magnets was packed in polystyrene foam of a thickness of 10 mm so that the magnets did not become inseparable because of their attraction. As the working example, four permanent magnets 2 were lined up in two rows and two columns, and made into a permanent magnet package 1 (FIG. 2(*c*)). In the present working example, the magnetization direction of magnets in the same row is set to be the same, and the magnetization direction of different rows is set to be opposite. As Comparative Example 1, four magnets were lined up in a single row, to make a permanent magnet package 10 (FIG. 2(*a*)). The magnetization direction of the magnets was set to be the same. Further, as Comparative Example 2, four magnets were lined up in two rows and two columns to make the permanent magnet package 10 (FIG. 1(*b*)). In Comparative Example 2, the magnetization direction of the magnets in the same row was set to be the same, and the magnetization direction of different rows was also the same.

Accordingly, the total length of the lines that link N poles and S poles of the magnets was 160 mm in Comparative Example 1, 130 mm in Comparative Example 2 and 80 mm in the present Working Example. Specifically, in Comparative Example 1, there are lengths of 20 mm between the N poles and S poles of the magnets in three locations, and one length of 100 mm between the end N pole and the end S pole, giving a total of 160 mm. In Comparative Example 2, there are lengths of 20 mm between the N pole and S pole of the magnets in the same row in two locations, and 45 mm between the N pole end of one row and the S pole end of the other row between the different rows, totaling 130 mm. In the present Working Example, there are lengths of 20 mm between the N pole and S pole of the magnets in the same row in two locations, and 20 mm between the N pole ends of one row and the S pole ends of the other row between the different rows, totaling 80 mm.

For the working example and the comparative examples, the strength of the leaking magnetic field was measured by a gauss meter at a position A located 500 mm from the center point of the magnets. In the case of Comparative Example 1, the strength of the leaking magnetic field was 127 A/m. In the case of Comparative Example 2, the strength of the leaking magnetic field was 96 A/m. In the case of the present Working Example, the strength of the leaking magnetic field was 8 A/m. Thus, in the present working example it was possible to reduce the leaking magnetic field to 1/16 the strength of a conventional case in which the magnets are simply lined up in one row.

Thus, according to the present invention, it is possible to reduce magnetic field leakage when packing a plurality of magnetized magnets, there is also little leakage during storage and transport and the like, and it is possible to maintain the magnet's characteristics.

The invention claimed is:

1. A permanent magnet package comprising:

a plurality of magnet rows, wherein each of the magnet rows comprises a plurality of permanent magnets, wherein the magnetization direction of all the permanent magnets in a single magnet row is the same, and is parallel to the magnet row, wherein the plurality of the magnet rows are arranged such that the magnetization direction of adjacent rows is opposite, and wherein each of the permanent magnets is individually covered by a packing material so that the magnets can be individually and separately removed from the magnet package.

2. A permanent magnet package comprising:

a plurality of permanent magnets, wherein when packing by arranging the permanent magnets in a packing container, each of the permanent magnets is arranged in such orientations that a total length of straight lines that link N poles and S poles of the permanent magnets to be closed is minimized among cases when the same number of permanent magnets are arranged, and wherein each of the permanent magnets is individually covered by a packing material so that the magnets can be individually and separately removed from the magnet package.

3. A method for manufacturing a permanent magnet package, the method comprising:

providing a magnet row comprising a plurality of permanent magnets, wherein the magnet row is arranged such that the magnetization direction of all the permanent magnets in a single magnet row is the same, and is parallel to the magnet row; and arranging a plurality of the magnet rows of the permanent magnets such that each of the permanent magnet rows has a magnetization direction opposite to the magnet row adjacent thereto, wherein the magnets can be individually and separately removed from the magnet package.

4. A method for manufacturing a permanent magnet package comprising a plurality of permanent magnets, the method comprising:

arranging the permanent magnets such that when packing by arranging the permanent magnets in a packing container, each of the permanent magnets is arranged in such orientations that a total length of straight lines that link N poles to the S poles of the permanent magnets to be closed is minimized among cases when the same number of permanent magnets are arranged, and wherein each of the permanent magnets is individually covered by a packing material so that the magnets can be individually and separately removed from the magnet package.

5. A method for transporting a plurality of permanent magnets, the method comprising:

transporting the plurality of permanent magnets by using the permanent magnet package according to claim 1.

6. The permanent magnet package according to claim 1, wherein each of the magnet rows comprises at least three permanent magnets.

7. The permanent magnet package according to claim 2, wherein each of the magnet rows comprises at least three permanent magnets.

8. The method for manufacturing a permanent magnet package according to claim 3, wherein each of the permanent magnets is individually covered by a packing material.

9. The meted for manufacturing a permanent magnet package according to claim 3, wherein each of to magnet rows comprises at least tree permanent magnets.

10. The method for manufacturing a permanent magnet package according to claim 4, wherein each of to magnet rows comprises at least three permanent magnets.

11. The method for transporting a plurality of permanent magnets according to claim 5, wherein each of to magnet rows comprises at least three permanent magnets.

12. A meted for transporting a plurality of permanent magnets, the method comprising:

transporting the plurality of permanent magnets by using the permanent magnet package according to claim 2.

13. The method for transporting a plurality of permanent magnets according to claim 12, wherein each of to magnet rows comprises at least three permanent magnets.

* * * * *

UNITED STATES PATENT AND TRADEMARK OFFICE

CERTIFICATE OF CORRECTION

PATENT NO. : 7,307,501 B2
APPLICATION NO. : 11/076118
DATED : December 11, 2007
INVENTOR(S) : Doi It is certified that error appears in the above-identified patent and that said Letters Patent is hereby corrected as shown below:

Column 10, Claim 9, Line 26: Please correct "each of to"
To read -- each of the --

Column 10, Claim 9, Line 27: Please correct "at least tree"
To read -- at least three --

Column 10, Claim 10, Line 29: Please correct "each of to"
To read -- each of the --

Column 10, Claim 11, Line 32: Please correct "each of to"
To read -- each of the --

Column 10, Claim 12, Line 34: Please correct "A meted"
To read -- A method --

Signed and Sealed this

Fifth Day of May, 2009

John Doll

JOHN DOLL
*Acting Director of the United States Patent and Trademark Office*